US011067357B1

(12) United States Patent
Chu et al.

(10) Patent No.: US 11,067,357 B1
(45) Date of Patent: Jul. 20, 2021

(54) STRING PULLING MECHANISM OF CROSSBOW

(71) Applicant: Man Kung Enterprise Co., Ltd., Taichung (TW)

(72) Inventors: Fu-Hui Chu, Taichung (TW); Ching-Chi Hung, Taichung (TW)

(73) Assignee: Man Kung Enterprise Co., Ltd., Taichung (TW)

( * ) Notice: Subject to any disclaimer, the term of this patent is extended or adjusted under 35 U.S.C. 154(b) by 0 days.

(21) Appl. No.: 16/915,197

(22) Filed: Jun. 29, 2020

(30) Foreign Application Priority Data

Jun. 2, 2020 (TW) ..... 109206859

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12; F41B 5/123
See application file for complete search history.

(56) References Cited

U.S. PATENT DOCUMENTS

| | | | | |
|---|---|---|---|---|
| 8,453,631 | B1 * | 6/2013 | Kronengold | F41A 19/12 124/25 |
| 8,950,385 | B1 * | 2/2015 | Khoshnood | F41B 5/12 124/25 |
| 9,404,706 | B2 * | 8/2016 | Khoshnood | F41B 5/12 |
| 10,295,295 | B2 * | 5/2019 | Shaffer | F41B 5/12 |
| 10,295,299 | B2 * | 5/2019 | Vergara | B66D 1/04 |
| 10,421,637 | B1 * | 9/2019 | Huang | B65H 75/4494 |
| 10,612,884 | B2 * | 4/2020 | Walthert | F41B 5/12 |
| 10,900,738 | B1 * | 1/2021 | Hensel | F41B 5/12 |

* cited by examiner

*Primary Examiner* — John A Ricci
(74) *Attorney, Agent, or Firm* — Alan D. Kamrath; Karin L. Williams; Mayer & Williams PC

(57) ABSTRACT

A string pulling mechanism includes a rolling assembly, a rotary shaft, a unidirectional bearing, two rollers, a switch, and a swing lever. The holder has a first accommodation portion, an opening, and a first coupling orifice. The unidirectional bearing includes an internal ring and an external ring having multiple teeth, the two rollers are fixed on the rotary shaft, and the switch is inserted to the opening of the rolling assembly and is rotatably connected with the rolling assembly. The switch is received into the opening so as to control the external ring to rotate or not rotate. The swing lever disposed on a side of the rolling assembly to actuate the rotary shaft, the internal ring of the unidirectional bearing, and the two rollers to rotate. The string is fixed on the two rollers and are inserted through and connected with a pull seat.

13 Claims, 18 Drawing Sheets

STRING PULLING MECHANISM OF CROSSBOW

BACKGROUND OF THE INVENTION

Field of the Invention

The present invention relates to a crossbow, and more particularly to a string pulling mechanism of the crossbow which is capable of being operated silently.

Description of the Prior Art

A conventional crossbow contains a body, a limb, a stock formed on a rear end of the body, a trigger assembly located ahead of the stock, a sight fixed on the trigger assembly, and an aim lens fixed on the sight. The limb is curved and is disposed adjacent to a front end of the body and intersects with the body to form a cross shape, and a bowstring is defined between two ends of the limb.

In operation, the bowstring is pulled backward to expand completely and to engage with the trigger assembly, and the limb is pulled by the bowstring to bend deformably, then an arrow is put on the body to contact with the bowstring, a target is aimed by the aim lens, and the trigger assembly is triggered so that the bowstring removes from the trigger assembly. In the meantime, the limb recovers an original shape to actuate the bowstring to shoot the arm quickly.

However, a user has to pull the bowstring forcefully with hands and feet because a tension of the bowstring of the crossbow. In other words, it is difficult to pull the bowstring, when the user has no great arm strength.

To overcome great application of force, as shown in FIGS. 17 and 18, a string pulling mechanism of a conventional crossbow has been developed and contains a base 100 having s connection portion 101 arranged on a top of the base 100; a controller 200 having a first cap 201, a second cap 202 covered with the first cap 201, and a control assembly 203 located inside the first cover, wherein the controller 200 is fixed by connecting first cap 201 with the connection portion 101 of the top of the base 100, and the control assembly 203 includes a rotary shaft 2031, two rollers 2032 mounted on the rotary shaft 2031, a scroll spring 2033, a driven gear 2034, and a drive gear 2035 meshed with the driven gear 2034, wherein a diameter of the drive gear 2035 is smaller than a diameter of the driven gear 2034, the drive gear 2035 is driven to actuate the driven gear 2034 to rotate, and the first cap 201 has two receiving orifices 2011 defined on a wall of the first cap 201 parallel to the rotary shaft 2031 and corresponding to the two rollers 2032; a hook member 303 formed in a U shape by three walls of the hook member 303, wherein the hook member 303 has two hooking portions 301 extending from two bottoms of two middles of two sides, and a groove 302 extending on the hook member 300, two rolling wheels 303 rotatably connected on two free ends of the hook member 300; a pull string 400 inserted through the groove 302 of the hook member 300 and the two rolling wheels 303, and two ends of the pull string 400 are rolled on the two rolling wheels 2032; a unidirectional ratchet 2036 fixed on the rotary shaft 2031, the first cap 201 further has a post 2037 inserted to another wall of a respective receiving orifice 2011, wherein the post 2037 is inserted to the first cap 201 to engage with teeth of the unidirectional ratchet 2036, and the post 2037 is pulled to remove from the unidirectional ratchet 2036.

The string pulling mechanism of the conventional crossbow is rotated by a swing lever, the drive gear actuates the two rolling wheels 2032 to rotatably roll the pull string 400 tightly, and the two hooking portions 301 pull the bowstring outward. When the two rolling wheels 2032 roll the pull string 400, the post 2037 strikes the unidirectional ratchet 2036 successively to make noises since the post 2037 engages with the unidirectional ratchet 2036 intermittently, thus scaring the prey and influencing hunting effect.

The present invention has arisen to mitigate and/or obviate the afore-described disadvantages.

SUMMARY OF THE INVENTION

The primary object of the present invention is to provide a string pulling mechanism of a crossbow which contains a string pulling mechanism not make any noises, thus avoiding scaring prey away in hunting.

To provide above-mentioned objects, a string pulling mechanism of a crossbow provided by the present invention contains: a string collector including a rolling assembly, a rotary shaft, a unidirectional bearing, two rollers, a switch, and a swing lever.

The rolling assembly has a first accommodation portion formed on a middle thereof, an opening communicating with the first accommodation portion, and a first coupling orifice passing through the first accommodation portions. The rotary shaft is rotatably inserted into the first coupling orifice of the rolling assembly.

The unidirectional bearing is received in the first accommodation portion of the rolling assembly and is fitted on the middle of the rotary shaft. The unidirectional bearing has an internal ring and an external ring fitted around an outer rim of the internal ring. The internal ring is connected with the rotary shaft, and the external ring has multiple teeth surrounding an outer rim thereof. The internal ring rotates unidirectionally with respective to the external ring, the two rollers are fixed on two sides of the rotary shaft, the switch is inserted to the opening of the rolling assembly and is rotatably connected with the rolling assembly, and the switch is received into the opening so as to control the external ring to rotate or not rotate.

The swing lever is disposed on a side of the rolling assembly to actuate the rotary shaft, the internal ring of the unidirectional bearing, and the two rollers to rotate.

Two ends of the string are fixed on the two rollers, and the string is inserted through and connected with a pull seat.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
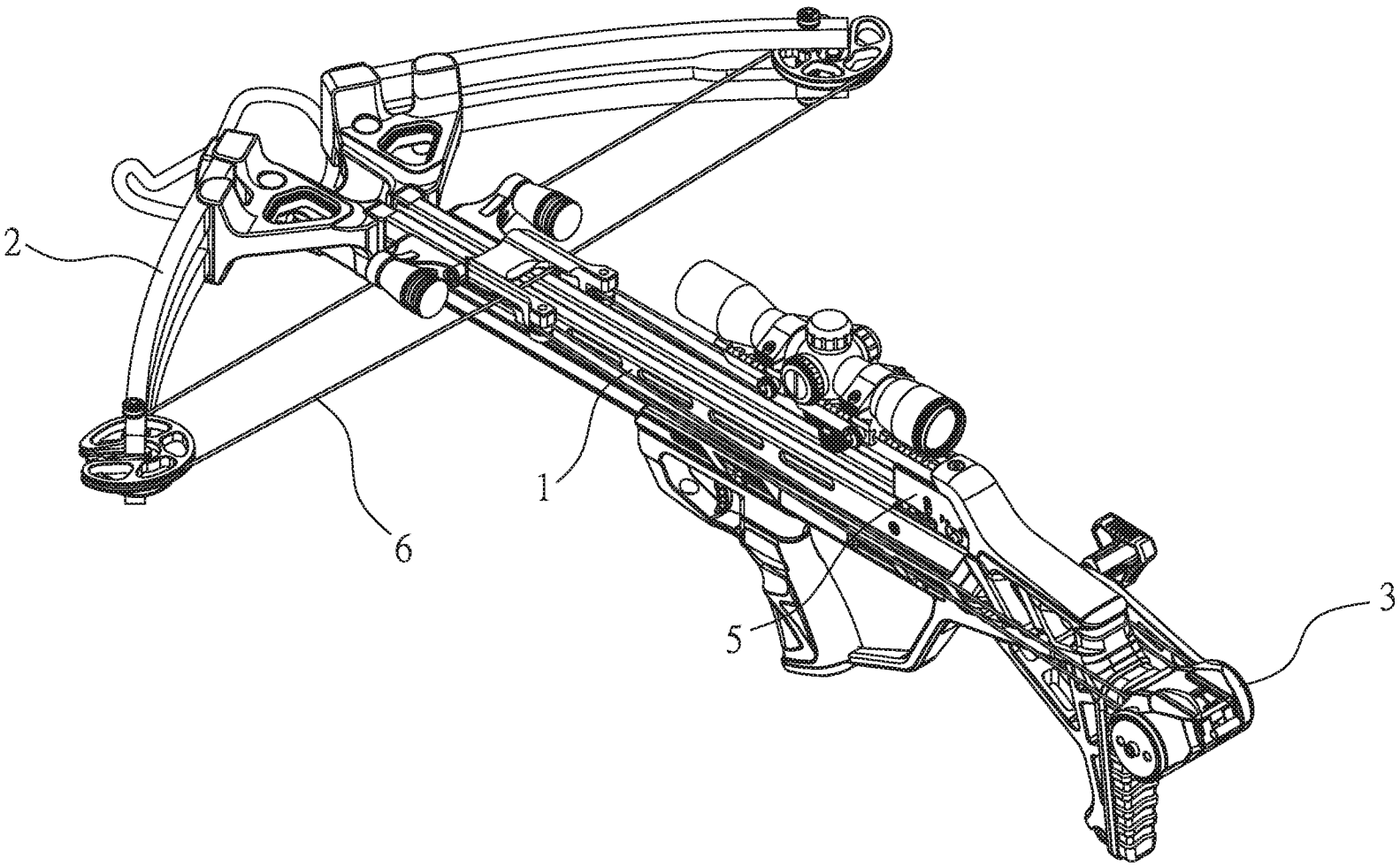
FIG. 1 is a perspective view showing the assembly of a crossbow according to a preferred embodiment of the present invention.
Figure 2:
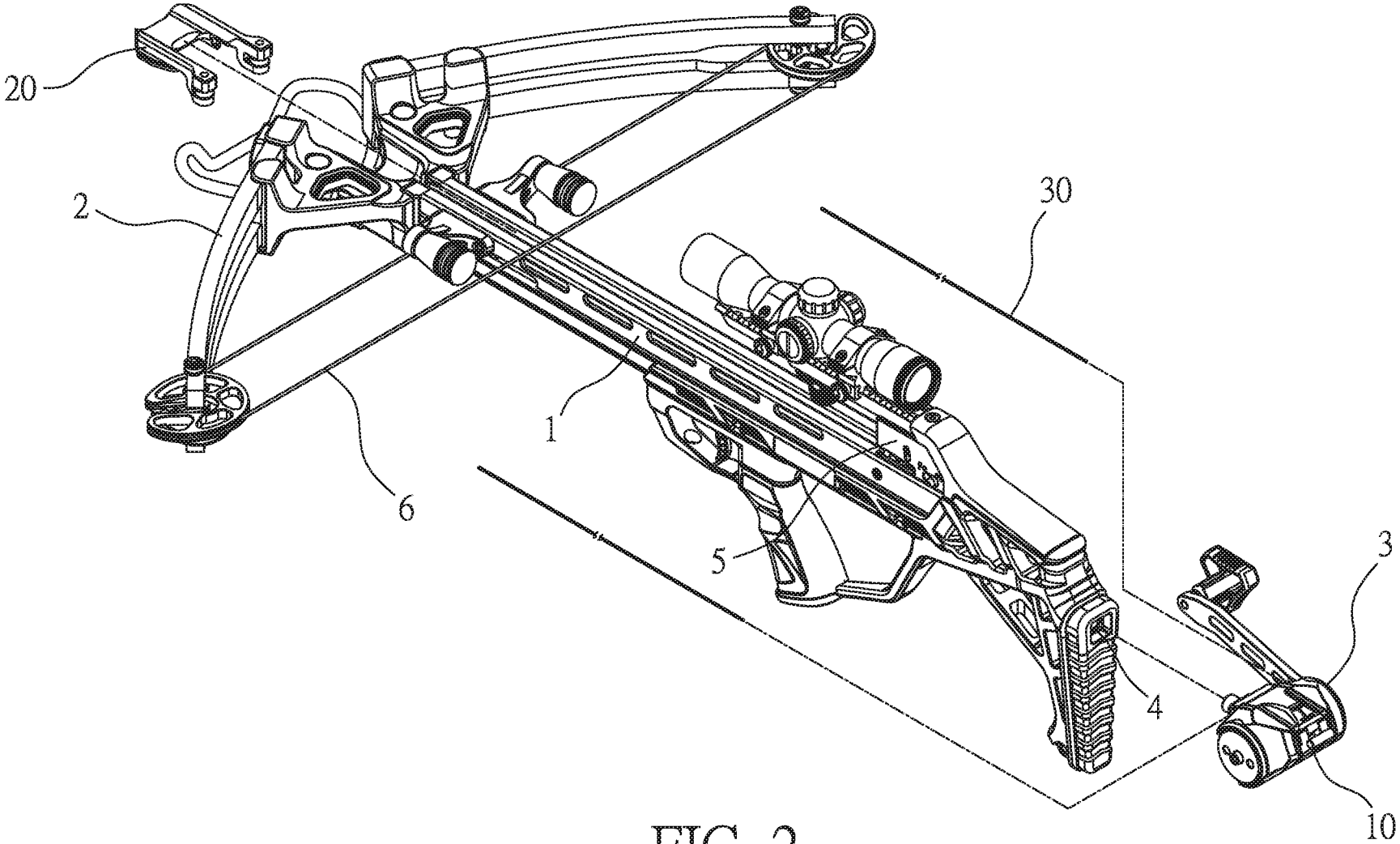
FIG. 2 is a perspective view showing the exploded components of the crossbow according to the preferred embodiment of the present invention.
Figure 3:
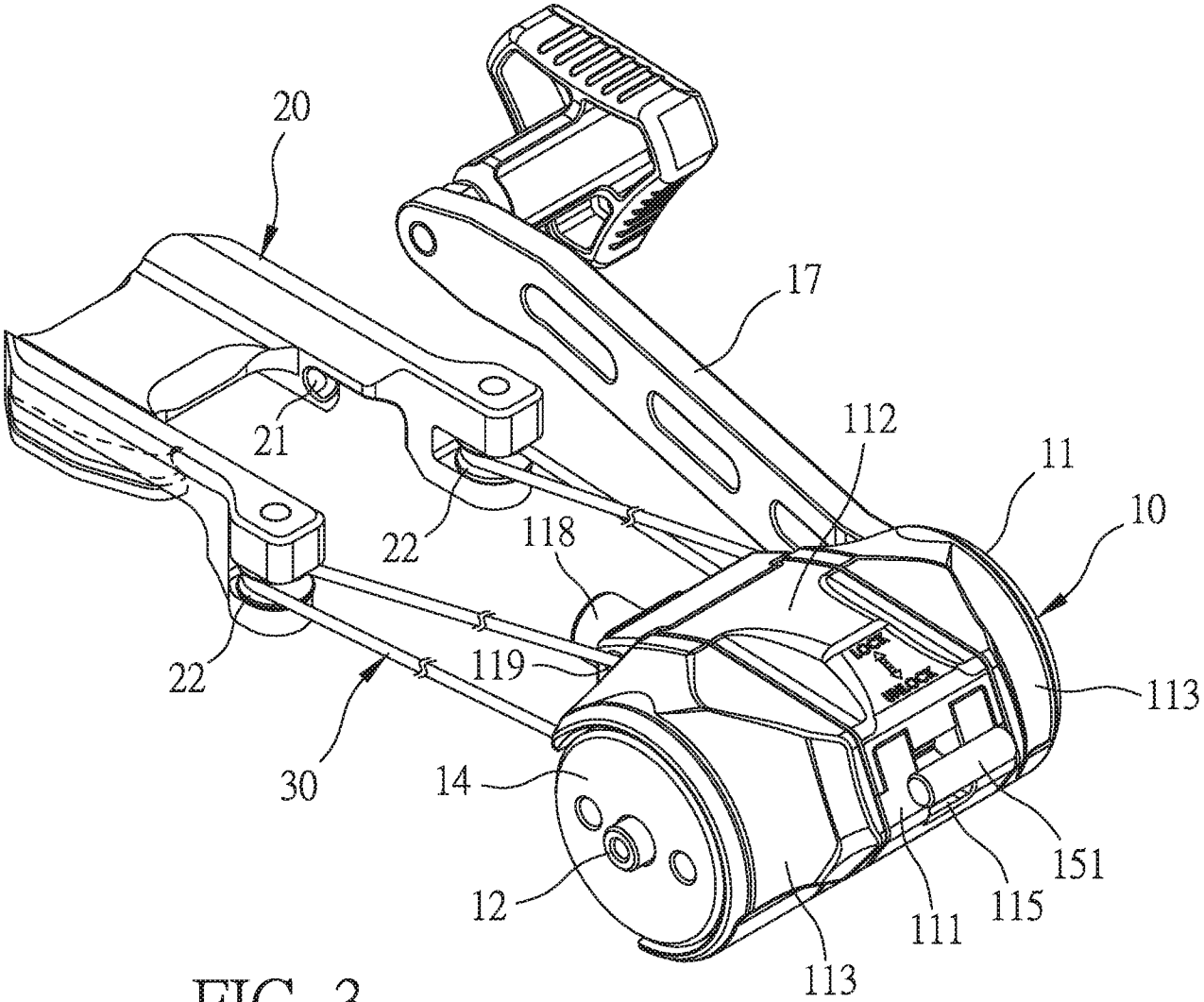
FIG. 3 is a perspective view showing the assembly of a part of the crossbow according to the preferred embodiment of the present invention.
Figure 4:
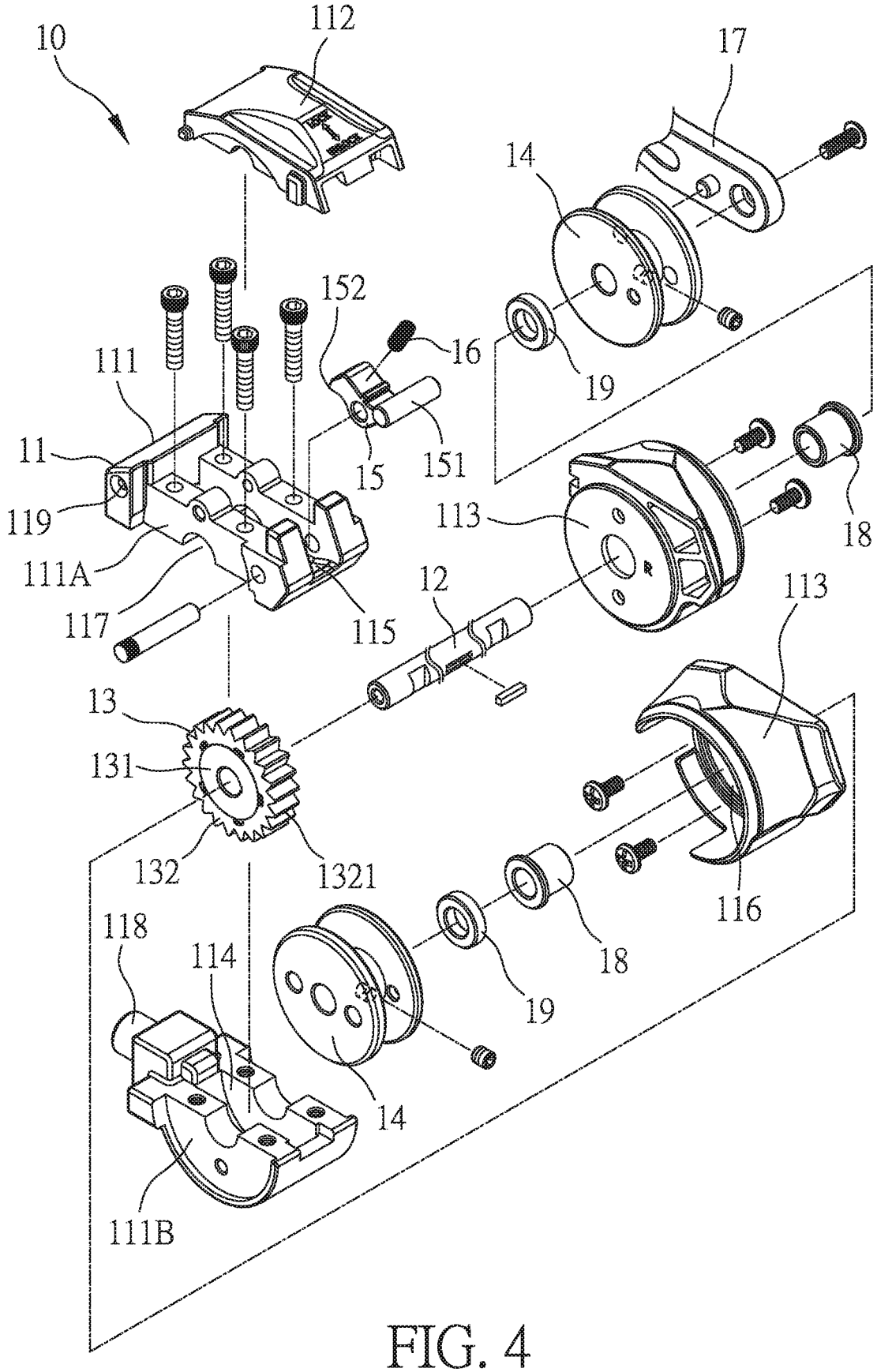
FIG. 4 is a perspective view showing the exploded components of a part of the crossbow according to the preferred embodiment of the present invention.
Figure 5:
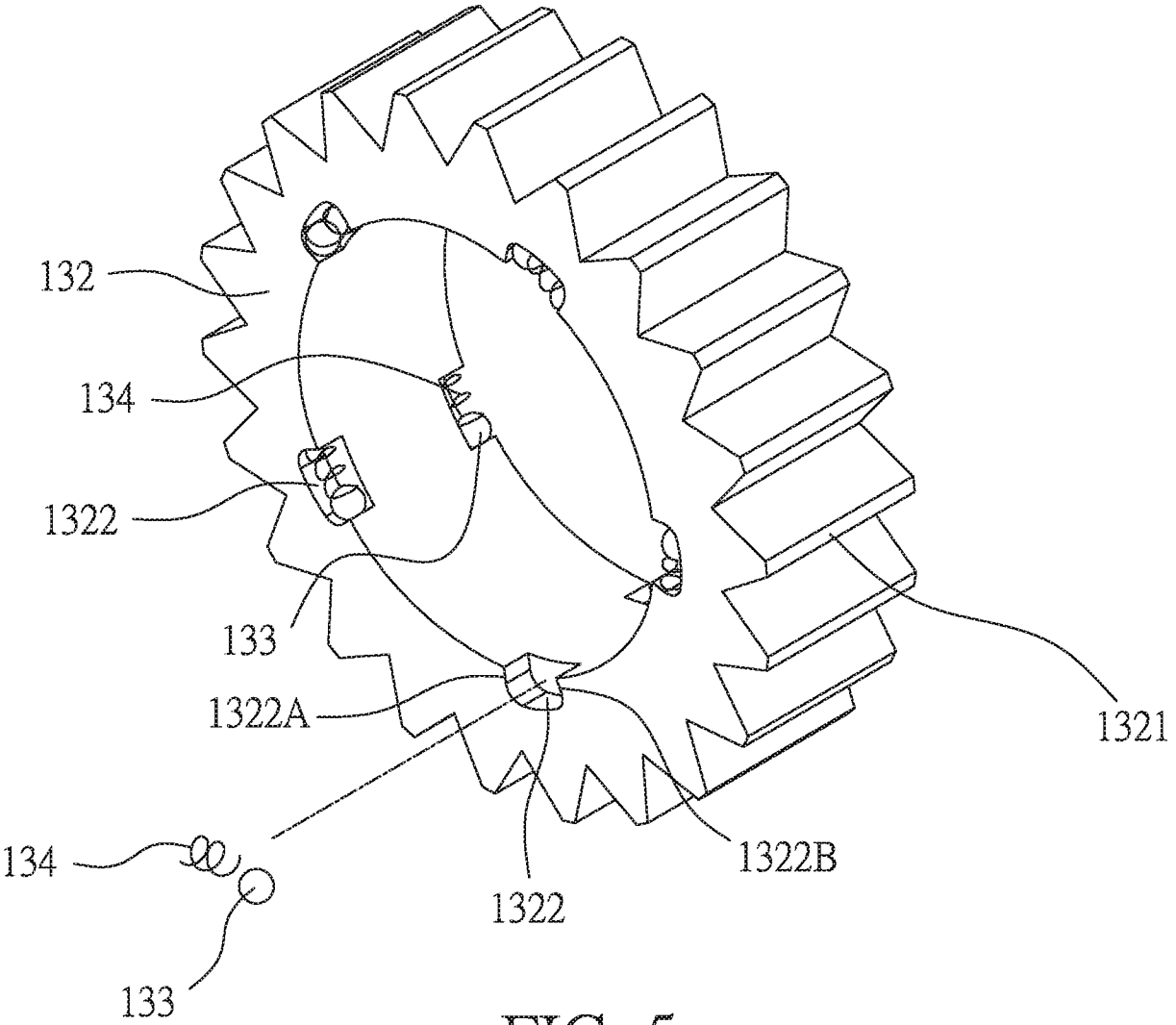
FIG. 5 is another perspective view showing the exploded components of a part of the crossbow according to the preferred embodiment of the present invention.
Figure 6:
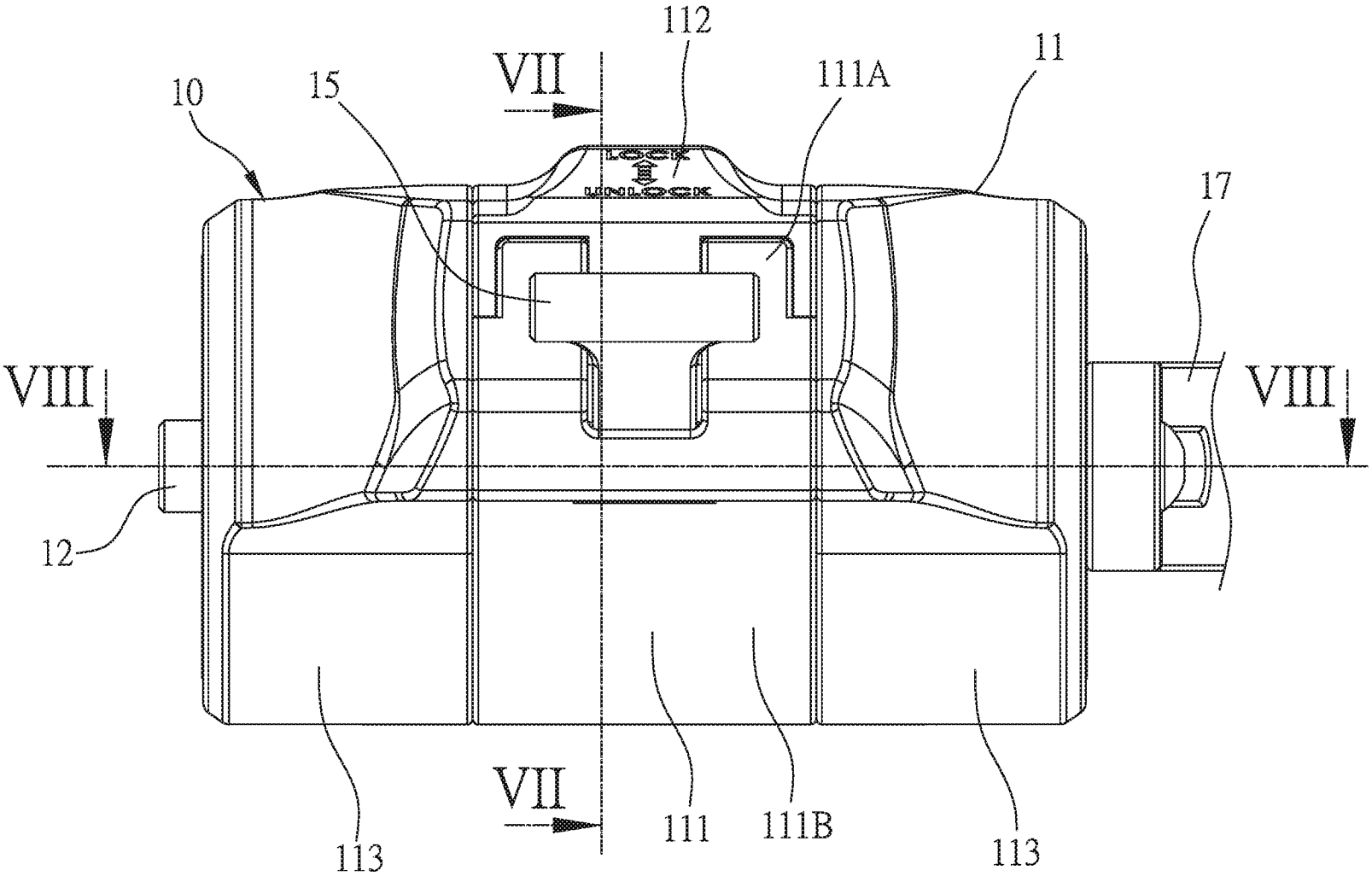
FIG. 6 is a side plan view showing the assembly of a part of the crossbow according to the preferred embodiment of the present invention.
Figure 7:
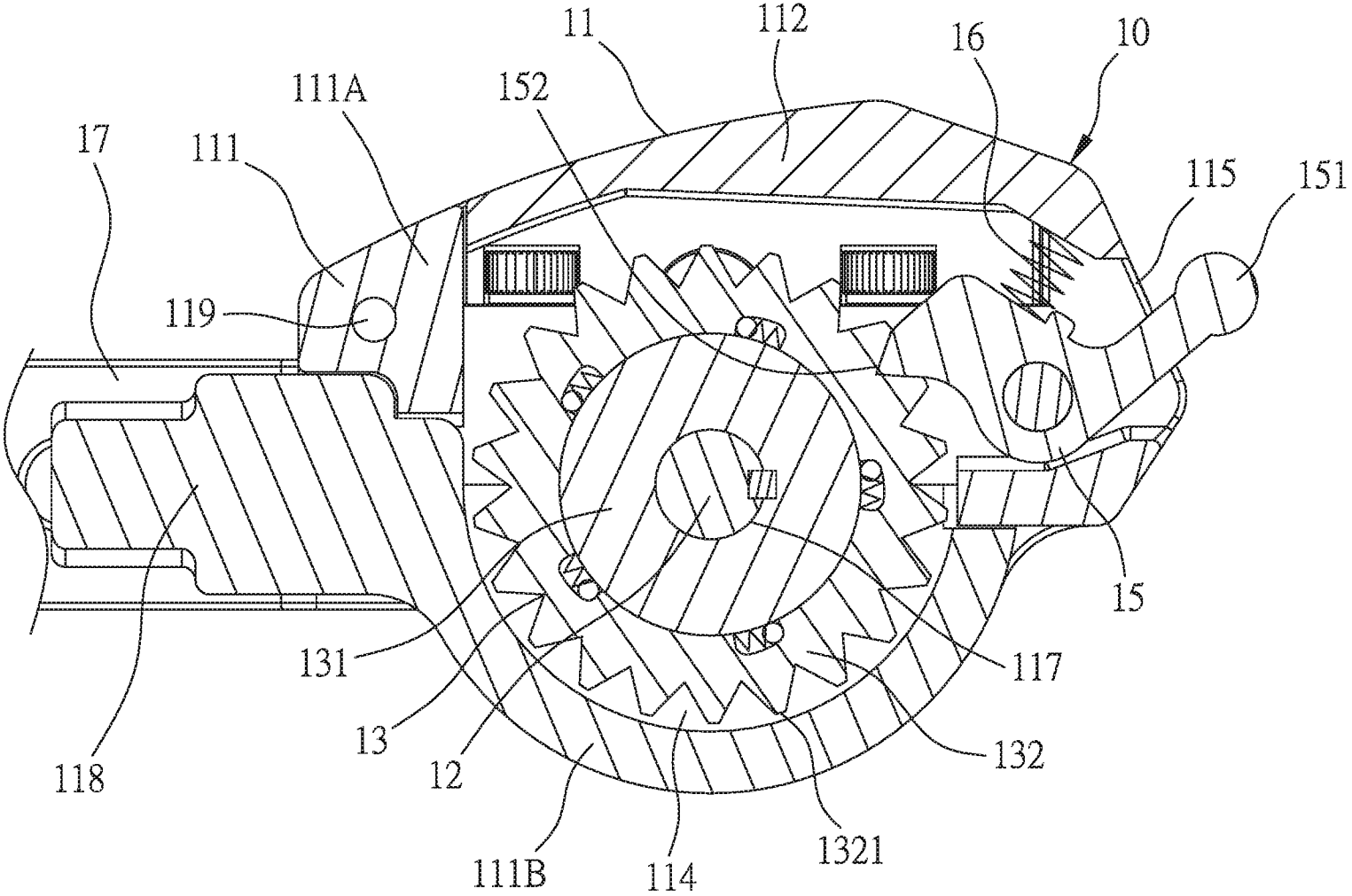
FIG. 7 is a cross sectional view taken along the line VII-VII of FIG. 6.
Figure 8:
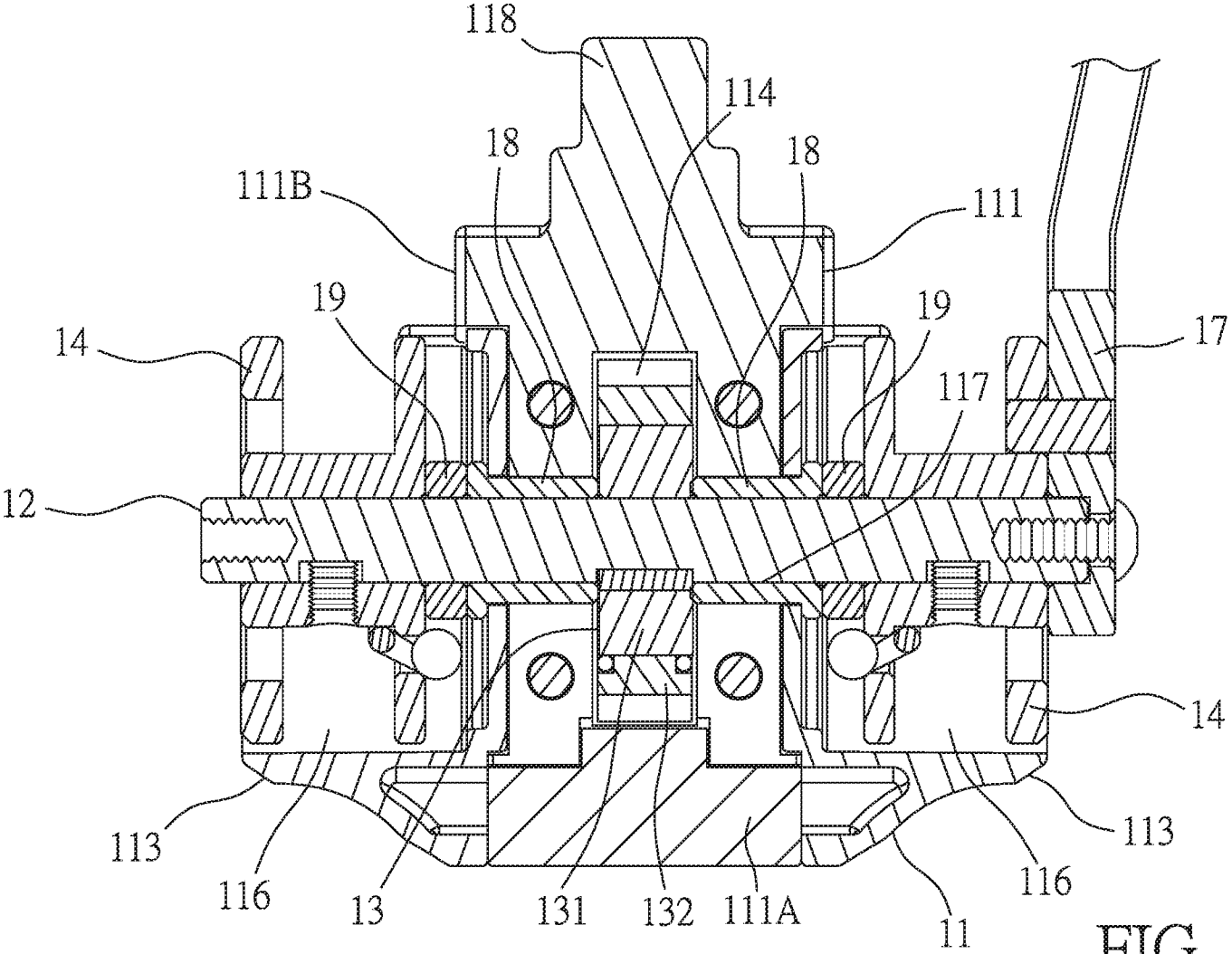
FIG. 8 is a cross sectional view taken along the line VIII-VIII of FIG. 6.
Figure 9:
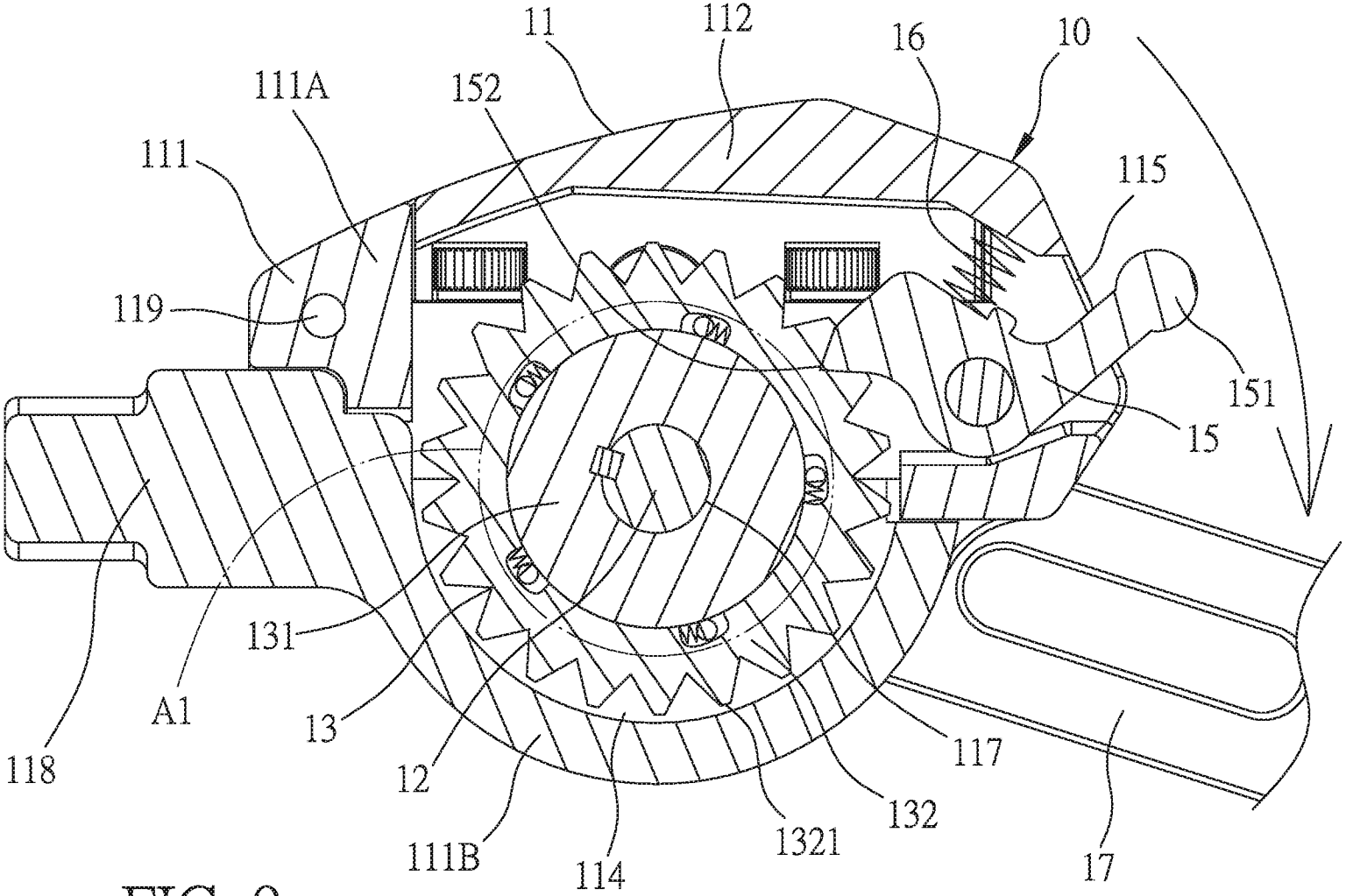
FIG. 9 is a cross sectional view showing the operation of a part of the crossbow according to the preferred embodiment of the present invention.
Figure 10:
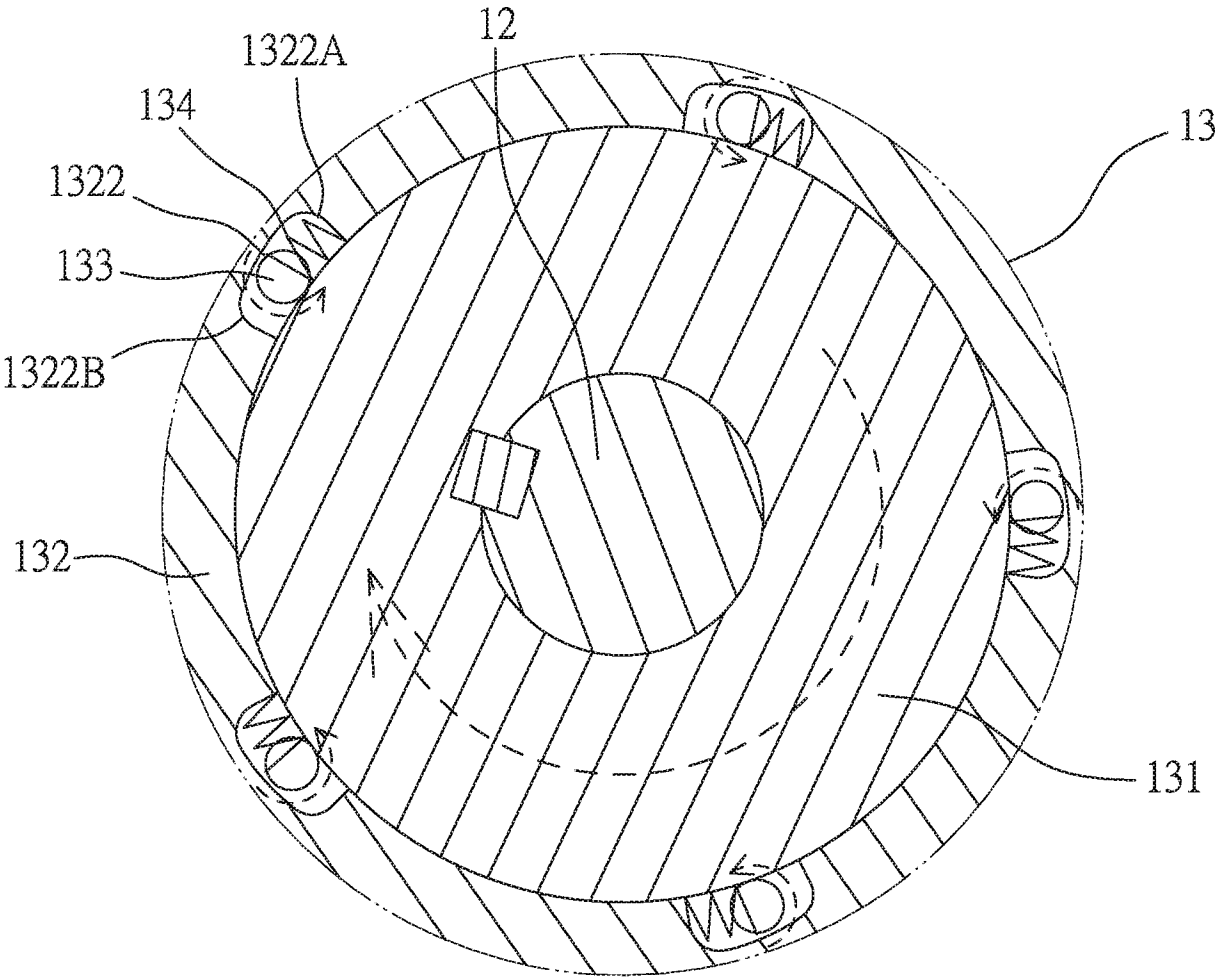
FIG. 10 is an amplified cross sectional view of a portion A1 of FIG. 9.
Figure 11:
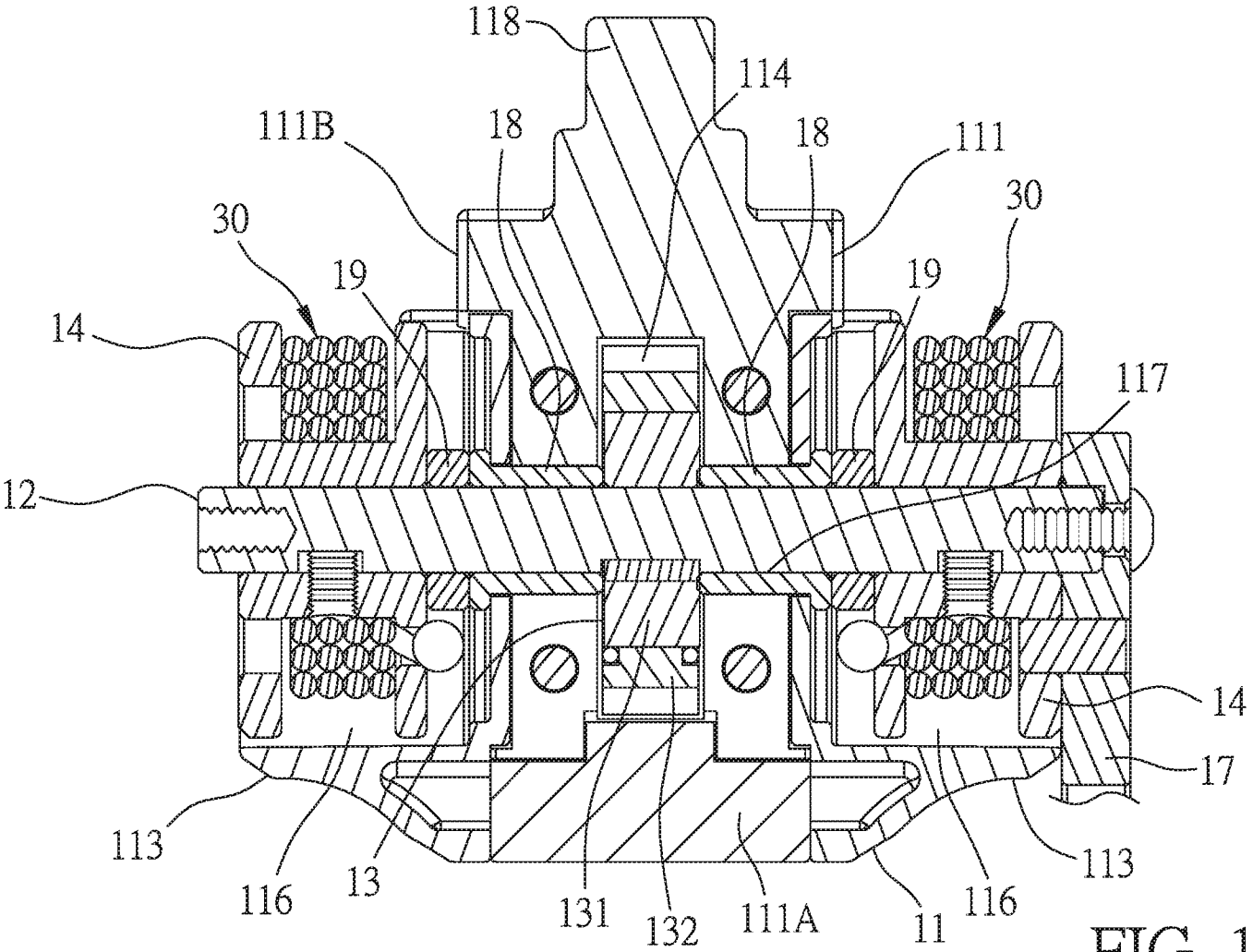
FIG. 11 is another cross sectional view showing the operation of a part of the crossbow according to the preferred embodiment of the present invention.
Figure 12:
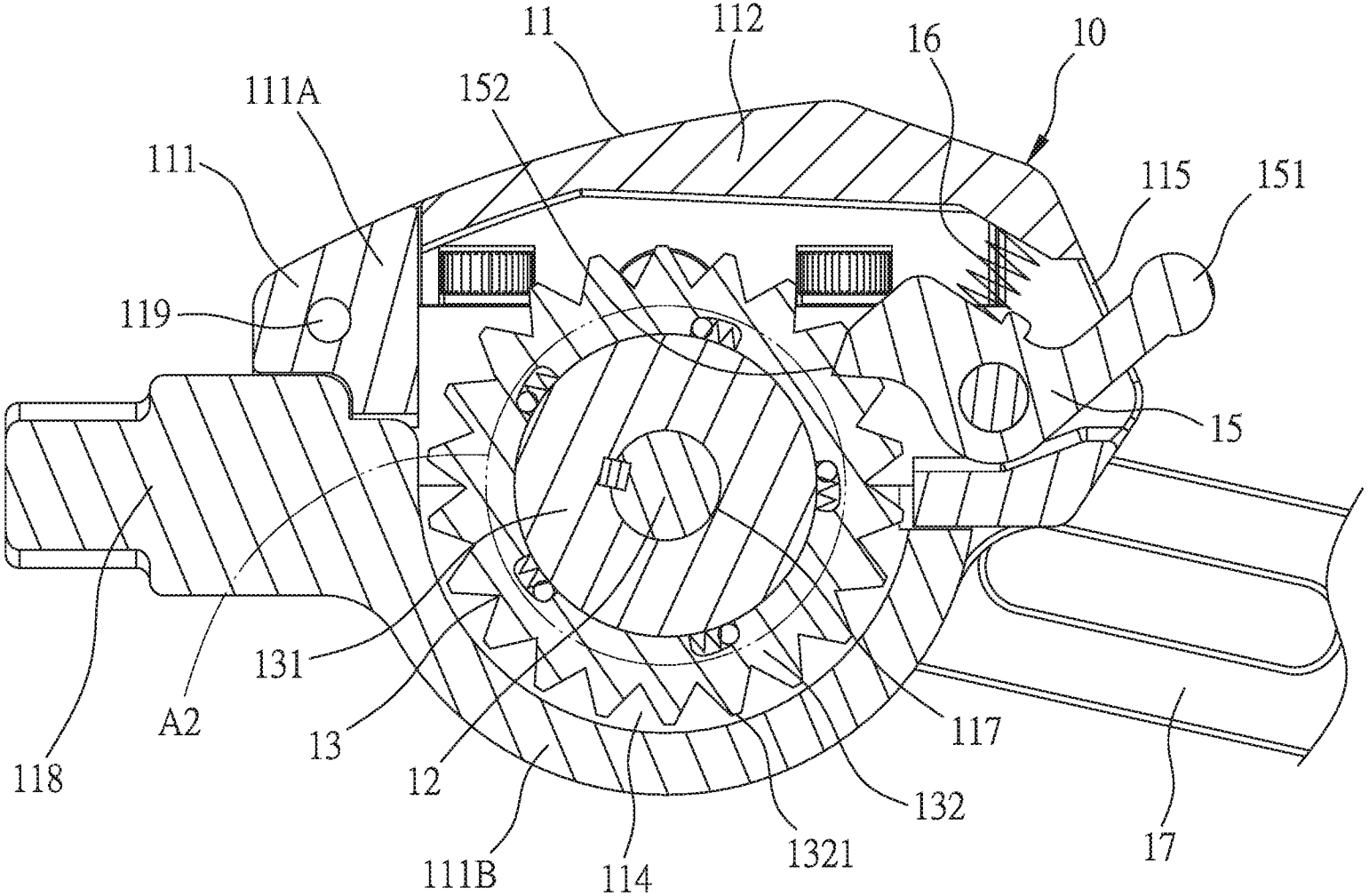
FIG. 12 is also another cross sectional view showing the operation of a part of the crossbow according to the preferred embodiment of the present invention.
Figure 13:
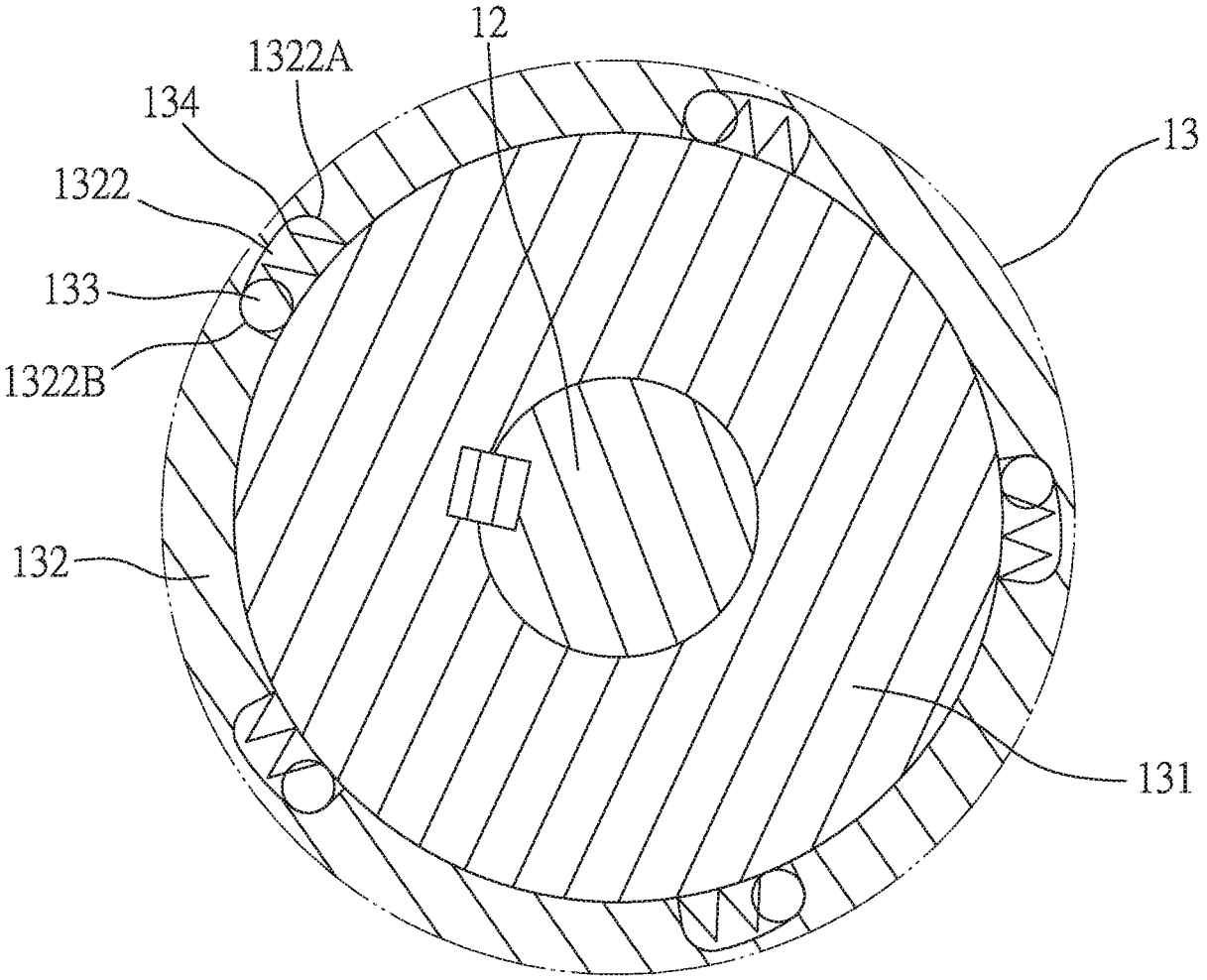
FIG. 13 is an amplified cross sectional view of a portion A2 of FIG. 12.
Figure 14:
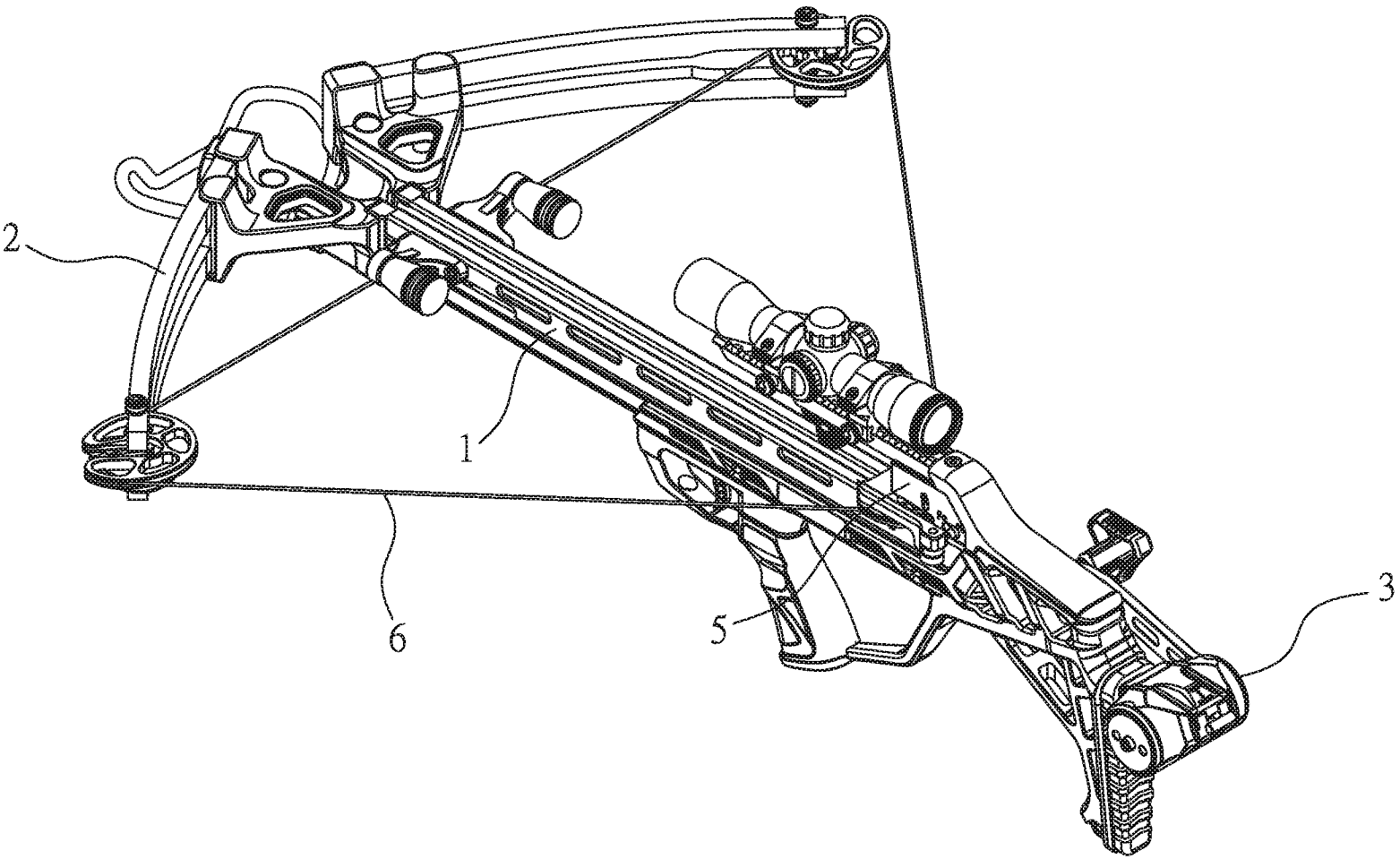
FIG. 14 is a perspective view showing the operation of the crossbow according to the preferred embodiment of the present invention.

With reference to FIGS. 1 and 2, a crossbow according to a preferred embodiment of the present invention comprises a body 1, a limb 2, a string pulling mechanism 3, a fixing orifice 4 defined on a rear end of the body 1, a trigger assembly 5 located adjacent to a rear end of the body 1, and a bowstring 6 defined between two ends of the limb 2, wherein the limb 2 is curved and is mounted proximate to a front end of the body 1 and intersecting with the body 1 to form a cross shape. The string pulling mechanism 3 includes a string collector 10, a pull seat 20, and a string 30.

Referring to FIGS. 3-8, the string collector 10 includes a rolling assembly 11, a rotary shaft 12, a unidirectional bearing 13, two rollers 14, a switch 15, a resilient element 16, a swing lever 17, two first sleeves 18, and two second sleeves 19.

The rolling assembly 11 has a holder 111, a cap 112 disposed on the holder 111, and two lids 113 connected on two sides of the holder 111, wherein the holder 111 has a first connection part 111A and a second connection part 111B connected with the first connection part 111A, and the rolling assembly 11 has a first accommodation portion 114 formed on a middle thereof, an opening 115 communicating with the first accommodation portion 114, two second accommodation portions 116, a first coupling orifice 117 passing through the first accommodation portions 114 and the two second accommodation portions 116, a locating portion 118 arranged on a front end of the rolling assembly 11, and a second coupling orifice 119 formed on the front end of the rolling assembly 11 parallel to the first coupling orifice 117, wherein the locating portion 118 is in connected with the fixing orifice 4 of a rear end of the body 1.

The rotary shaft 12 is rotatably inserted into the first coupling orifice 117 of the rolling assembly 11.

The unidirectional bearing 13 is received in the first accommodation portion 114 of the rolling assembly 11 and is fitted on the rotary shaft 12. The unidirectional bearing 13 has an internal ring 131 and an external ring 132 fitted around an outer rim of the internal ring 131, wherein the internal ring 131 is connected with the rotary shaft 12, the external ring 132 has multiple teeth 1321 surrounding an outer rim thereof, multiple recesses 1322 equidistantly formed on an inner rim of the external ring 132, wherein a respective recess 1322 has a first segment 1322A and a second segment 1322B, and a depth of the first segment 1322A is greater than a depth of the second segment 1322B, wherein the respective recess 1322 accommodates a rolling element 133 and a spring 134, and the rolling element 133 is pushed by the spring 134 to move from the first segment 1322A to the second segment 1322B so that the rolling element 133 moves back to the second segment 1322B automatically.

The two rollers 14 are received in the two second accommodation portions 116 of the rolling assembly 11 and are fitted with the rotary shaft 12 so that the two rollers 14 actuate the rotary shaft 12.

The switch 15 is inserted to the opening 115 of the rolling assembly 11 and is rotatably connected with the rolling assembly 11, wherein the switch 15 has an operation portion 151 extending out of the opening 115, and the switch 15 has an insertion 152 received into the opening 115, wherein the insertion 152 is engaged between two teeth 1321 of the external ring 132 of the unidirectional bearing 13 so as to control the unidirectional bearing 13 to rotate or not rotate.

The resilient element 16 is defined between the switch 15 and the rolling assembly 11 so as to push the insertion 152 of the switch 15 to the external ring 132 of the unidirectional bearing 13, such that the insertion 152 of the switch 15 is engaged between the two teeth 1321 of the external ring 132 of the unidirectional bearing 13 to position the external ring 132 of the unidirectional bearing 13. In addition, the resilient element 16 is a spring.

The swing lever 17 is disposed on a side of the rolling assembly 11 to lock with the rotary shaft 12 and to actuate one of the two rollers 14, such that the swing lever 17 drives the rotary shaft 12, the internal ring 131 of the unidirectional bearing 13, and the two rollers 14 to rotate.

The two first sleeves 18 are fitted on an outer rim of the rotary shaft 12 and are defined among the unidirectional bearing 13 and the two rollers 14.

The two second sleeves 19 are fitted on an outer rim of the rotary shaft 12 and are defined among the two first sleeves 18 and the two rollers 14.

The pull seat 20 is in a U shape and includes two hooks portion 21 arranged on two bottoms of two middles of two sides thereof, two rolling wheels 22 rotatably connected on the two sides of the pull seat 20, wherein the pull seat 20 is slidably connected on the body 1 so as to be move along the body 1 stably.

The string 30 is rolled on the two rolling wheels 22 of the pull seat 20 and the second coupling orifice 119 of the rolling assembly 11, and two ends of the string 30 are fixed on the two rollers 14.

In operation, as shown in FIGS. 9-14, the two hook portions 21 of the pull seat 20 hook the bowstring 6, the swing lever 17 is rotated to actuate the rotary shaft 12, the internal ring 131 of the unidirectional bearing 13, and the two rollers 14 to revolve, in the meantime, the internal ring 131 revolves relative to the external ring 132, and the rolling element 133 is frictioned by the internal ring 132 to move to the first segment 1322A of the respective recess 1322 to press the spring 134, such that the internal ring 131 and the external ring 132 rotate idly, and the two rollers 14 roll the string 30 so that the rolling element 133 moves to the second segment 1322B of the respective recess 1322 so as to fix between the respective recess 1322 and the internal ring 131 and to be positioned by the switch 15 which mates with the external ring 132. Thereby, the rotary shaft 12, the internal ring 131 of the unidirectional bearing 13, the two rollers 14 rotate reversely to pull the pull seat 20 smoothly, and the bowstring 6 moves to the string collector 10 until the bowstring 6 is pulled to engage with the trigger assembly 5 silently.

Figure 15:
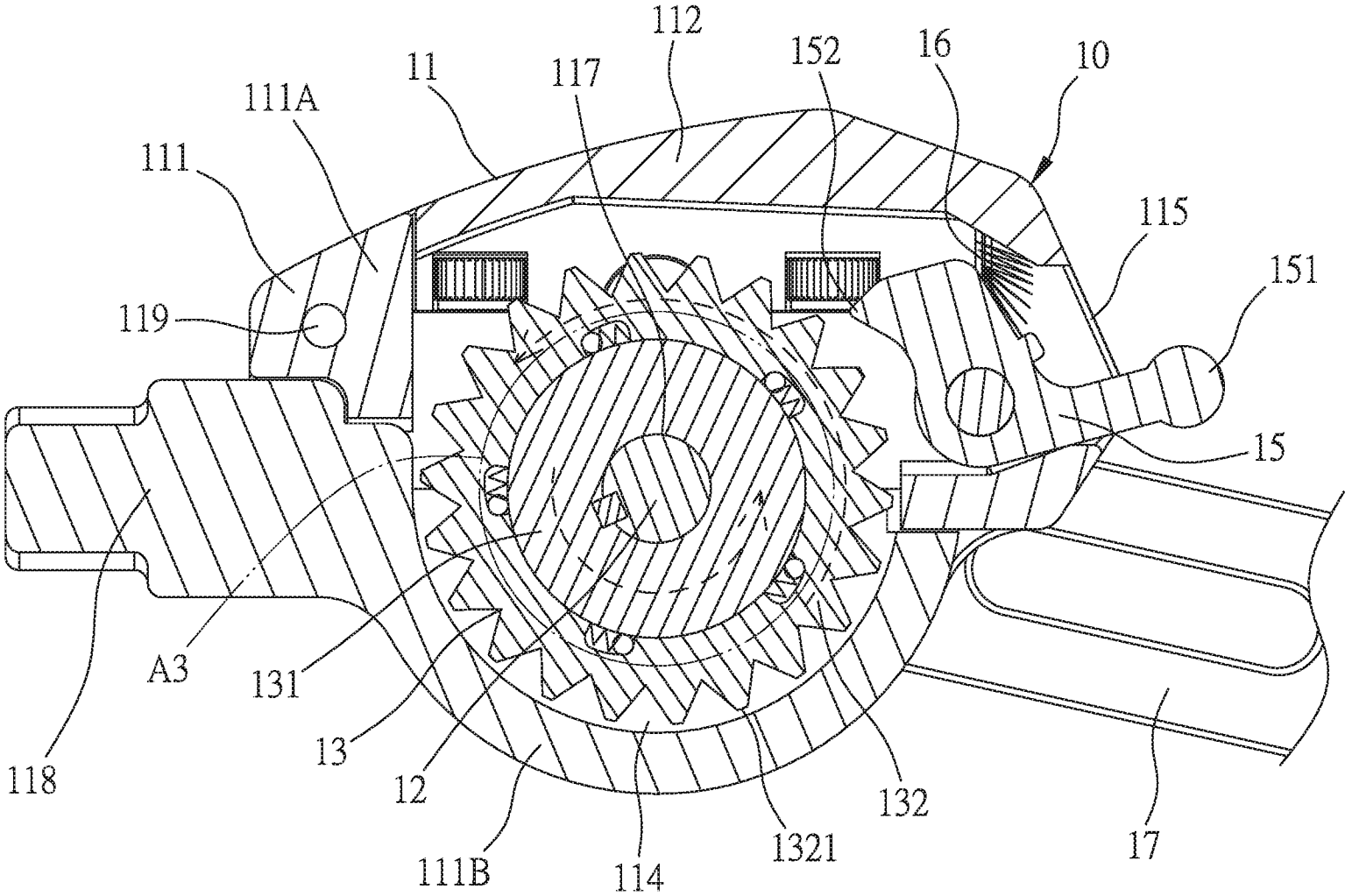
FIG. 15 is still another cross sectional view showing the operation of a part of the crossbow according to the preferred embodiment of the present invention.
Figure 16:
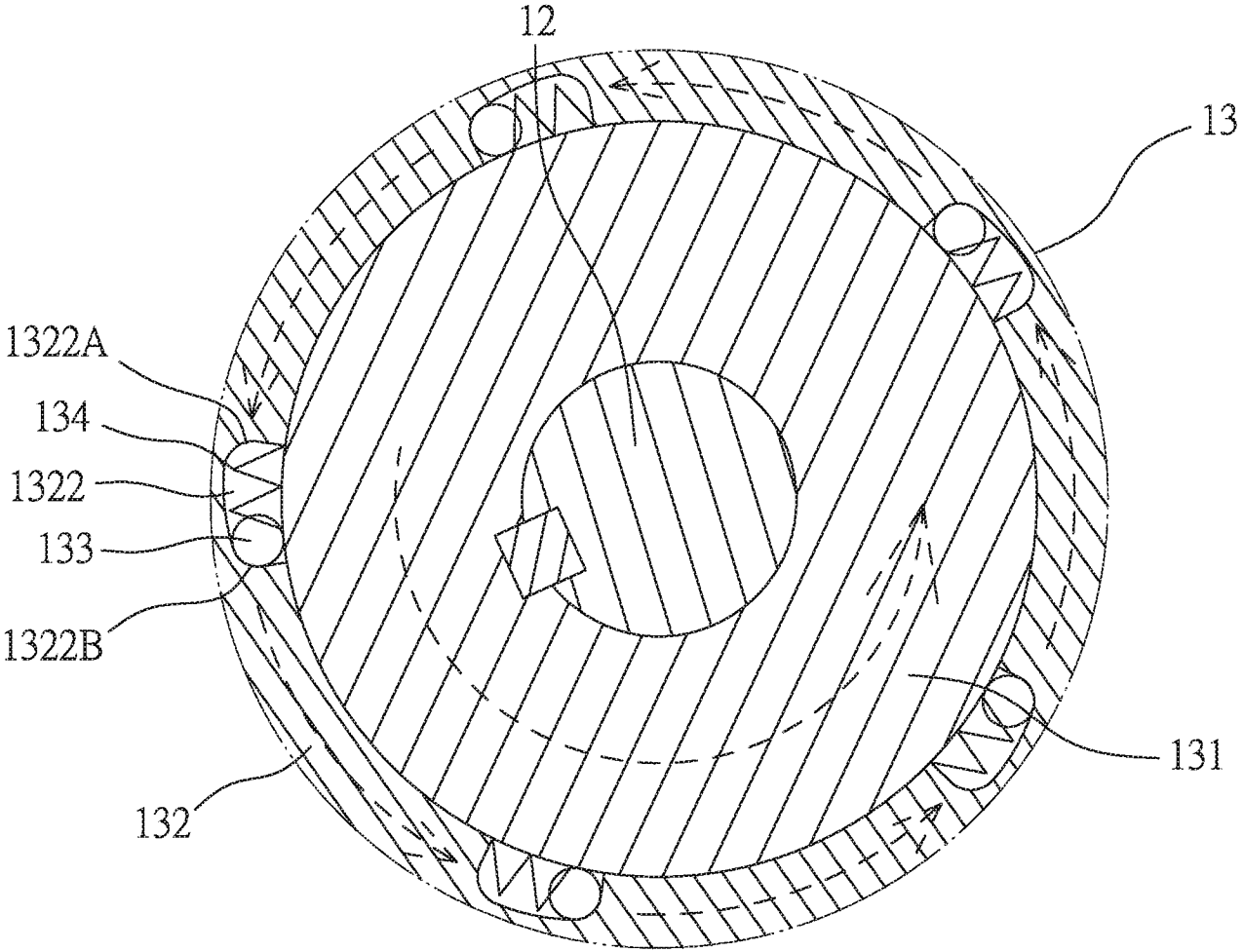
FIG. 16 is an amplified cross sectional view of a portion A3 of FIG. 15.
Figure 17:
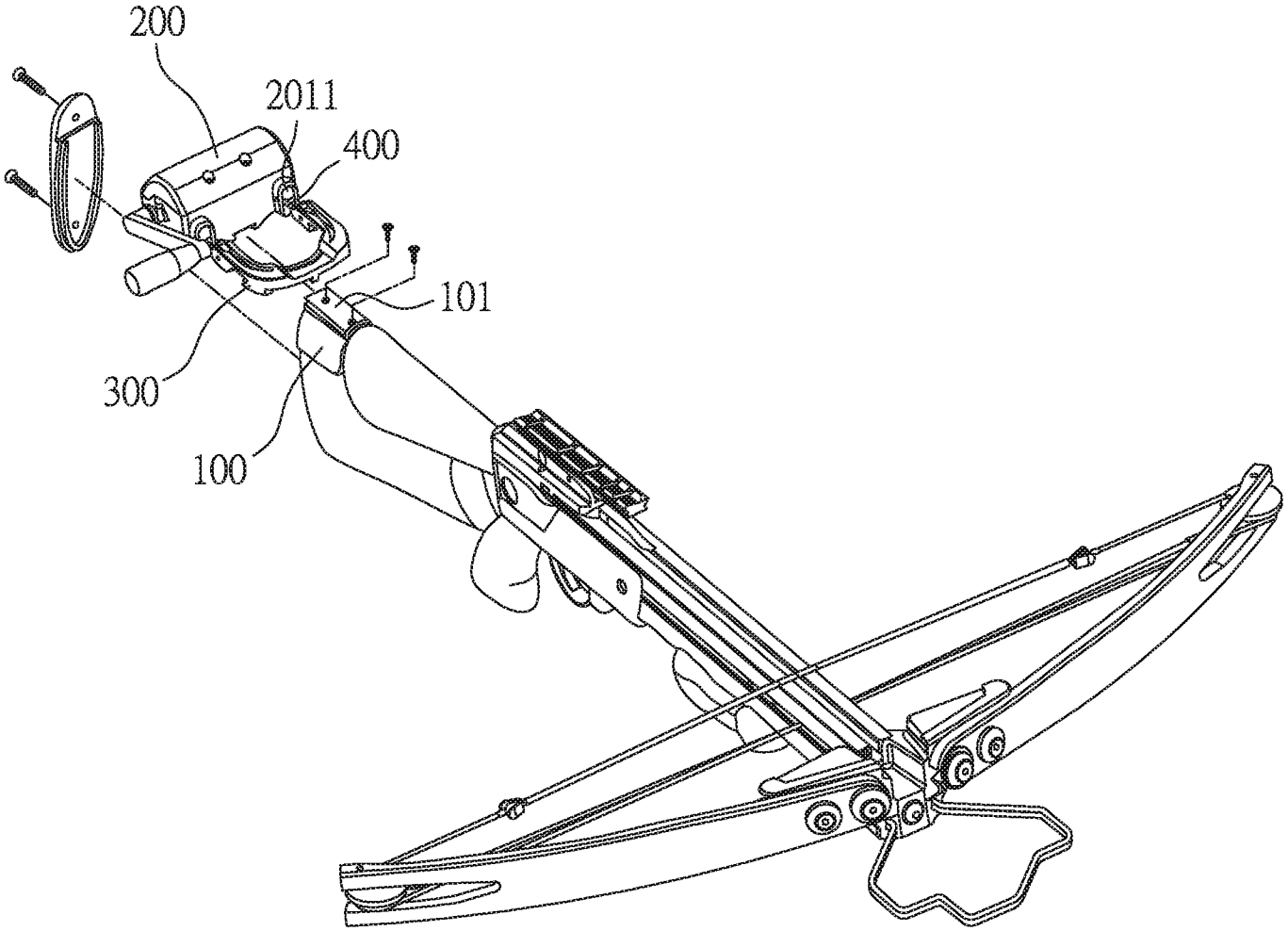
FIG. 17 PRIOR ART
FIG. 17 is a perspective view showing the exploded components of a conventional crossbow.
Figure 18:
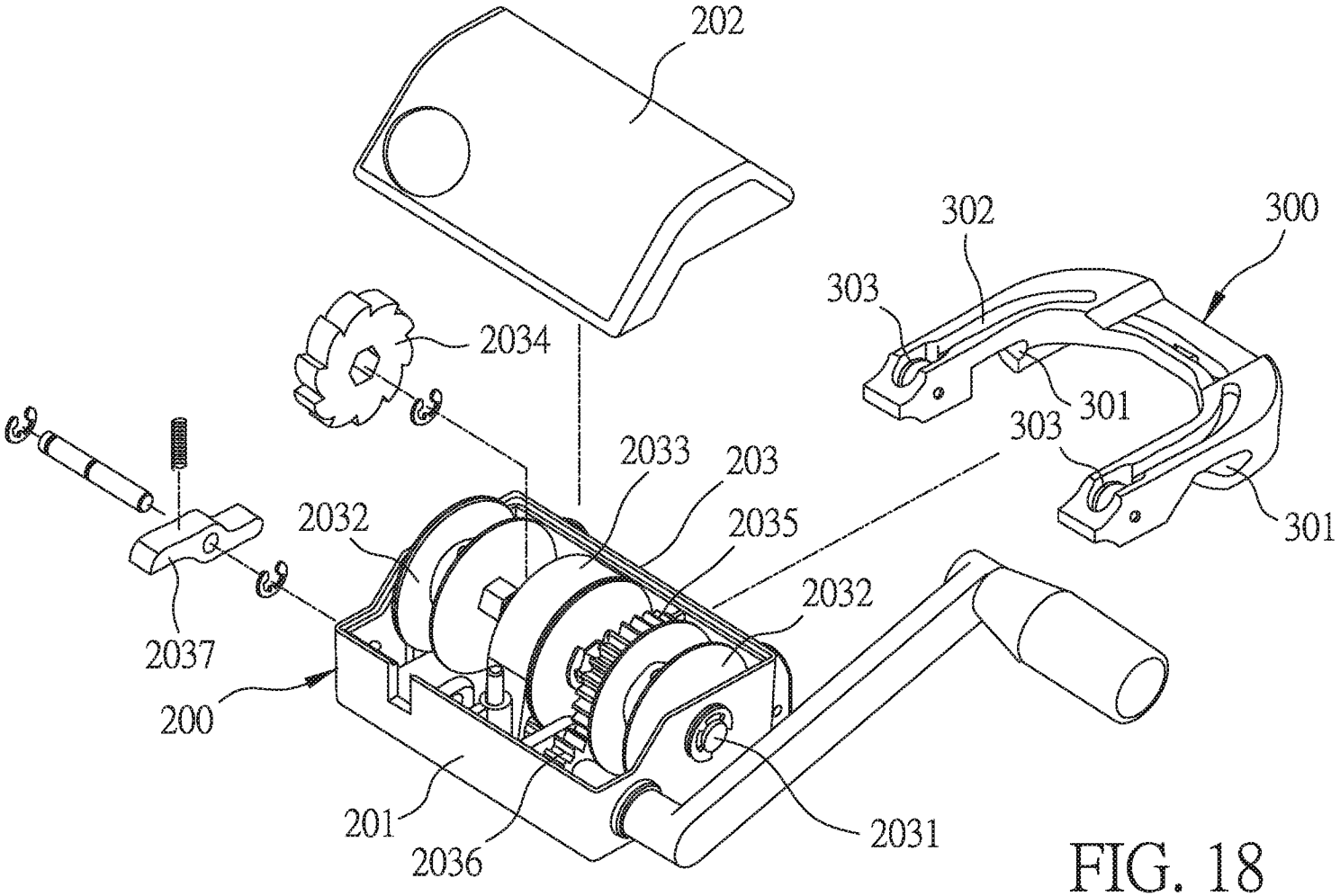
FIG. 18 PRIOR ART
FIG. 18 is a perspective view showing the exploded components of a string pulling mechanism of the conventional crossbow.

With reference to FIG. 15, the operation portion 151 of the switch 15 is pressed so that the insertion 152 of the switch 15 removes from the two teeth 1321 of the external ring 132 of the unidirectional bearing 13, the external ring 132 is not positioned, and the rotary shaft 12, the internal ring 131 of the unidirectional bearing 13, and the two rollers 14 rotate reversely so that the pull seat 20 is pulled back to an original position with the string 30. After releasing the operation portion 151 of the switch 15, the resilient element 16 pushes the insertion 152 of the switch 15 to engage between two teeth 1321 of the external ring 132 of the unidirectional bearing 13, thus re-positioning the external ring 132 of the unidirectional bearing 13.

Accordingly, the string pulling mechanism 3 of the present invention has advantages as follows:

The string pulling mechanism 3 is not driven by a ratchet and does not make any noises, thus avoiding scaring prey away in hunting and enhancing operational practicality.

While various embodiments in accordance with the present invention have been shown and described, it is clear to those skilled in the art that further embodiments may be made without departing from the scope of the present invention.

What is claimed is:

1. A string pulling mechanism of a crossbow comprising:

a string collector including a rolling assembly, a rotary shaft, a unidirectional bearing, two rollers, a switch, and a swing lever;

the rolling assembly having a first accommodation portion formed on a middle thereof, an opening communicating with the first accommodation portion, a first coupling orifice passing through the first accommodation portions, the rotary shaft being rotatably inserted into the first coupling orifice of the rolling assembly;

the unidirectional bearing received in the first accommodation portion of the rolling assembly and fitted on the middle of the rotary shaft, the unidirectional bearing having an internal ring and an external ring fitted around an outer rim of the internal ring, wherein the internal ring is connected with the rotary shaft, the external ring has multiple teeth surrounding an outer rim thereof, wherein the internal ring rotates unidirectionally with respective to the external ring, the two rollers are fixed on two sides of the rotary shaft, the switch is inserted to the opening of the rolling assembly and is rotatably connected with the rolling assembly, wherein the switch is received into the opening so as to control the external ring to rotate or not rotate;

the swing lever disposed on a side of the rolling assembly to actuate the rotary shaft, the internal ring of the unidirectional bearing, and the two rollers to rotate; and wherein two ends of the string are fixed on the two rollers, and the string is inserted through and connected with a pull seat.

2. The string pulling mechanism as claimed in claim 1, wherein the rolling assembly has a holder, a cap disposed on the holder, and two lids connected on two sides of the holder, wherein the holder has a first connection part and a second connection part connected with the first connection part.

3. The string pulling mechanism as claimed in claim 1, wherein the rolling assembly includes a locating portion arranged on a front end of the rolling assembly.

4. The string pulling mechanism as claimed in claim 1, wherein the rolling assembly further has a second coupling orifice formed a front end thereof parallel to the first coupling orifice and configured to receive the string.

5. The string pulling mechanism as claimed in claim 1, wherein the unidirectional bearing has multiple recesses equidistantly formed on an inner rim of the external ring, wherein a respective recess has a first segment and a second segment, and a depth of the first segment is greater than a depth of the second segment, wherein the respective recess accommodates a rolling element and a spring, and the rolling element is pushed by the spring to move from the first segment to the second segment so that the rolling element moves back to the second segment automatically.

6. The string pulling mechanism as claimed in claim 1, wherein the string collector further includes a resilient element defined between the switch and the rolling assembly so as to push the insertion of the switch to the external ring of the unidirectional bearing.

7. The string pulling mechanism as claimed in claim 6, wherein the resilient element is a spring.

8. The string pulling mechanism as claimed in claim 1, wherein the swing lever is disposed on a side of the rolling assembly to lock with the rotary shaft and to actuate one of the two rollers.

9. The string pulling mechanism as claimed in claim 1, wherein the string collector includes two first sleeves, the two first sleeves are fitted on an outer rim of the rotary shaft and are defined among the unidirectional bearing and the two rollers.

10. The string pulling mechanism as claimed in claim 9, wherein the string collector includes the two second sleeves, and the two second sleeves are fitted on an outer rim of the rotary shaft and are defined among the two first sleeves and the two rollers.

11. The string pulling mechanism as claimed in claim 1, wherein the switch has an operation portion extending out of the opening, and the switch has an insertion received into the opening, wherein the insertion is engaged between two teeth of the external ring of the unidirectional bearing.

12. The string pulling mechanism as claimed in claim 1, wherein the rolling assembly has two second accommodation portions configured to receive the two rollers.

13. The string pulling mechanism as claimed in claim 1, wherein the pull seat is in a U shape and includes two hooks portion arranged on two bottoms of two middles of two sides thereof, and the pull seat includes two rolling wheels rotatably connected on the two sides of the pull seat.

* * * * *